US009957631B2

(12) United States Patent
Kimoto et al.

(10) Patent No.: US 9,957,631 B2
(45) Date of Patent: May 1, 2018

(54) ELECTROPLATING APPARATUS FOR STEEL PIPES

(71) Applicants: NIPPON STEEL & SUMITOMO METAL CORPORATION, Tokyo (JP); VALLOUREC OIL AND GAS FRANCE, Aulnoye-Aymeries (FR)

(72) Inventors: Masanari Kimoto, Kobe (JP); Kazuya Ishii, Nishinomiya (JP); Masahiro Oshima, Wakayama (JP); Tatsuya Yamamoto, Singapore (SG)

(73) Assignees: NIPPON STEEL & SUMITOMO METAL CORPORATION, Tokyo (JP); VALLOUREC OIL AND GAS FRANCE, Aulnoye-Aymeries (FR)

( * ) Notice: Subject to any disclaimer, the term of this patent is extended or adjusted under 35 U.S.C. 154(b) by 40 days.

(21) Appl. No.: 15/038,161

(22) PCT Filed: Dec. 11, 2014

(86) PCT No.: PCT/JP2014/006181
§ 371 (c)(1),
(2) Date: May 20, 2016

(87) PCT Pub. No.: WO2015/087551
PCT Pub. Date: Jun. 18, 2015

(65) Prior Publication Data

US 2016/0298251 A1 Oct. 13, 2016

(30) Foreign Application Priority Data

Dec. 13, 2013 (JP) ..... 2013-258477

(51) Int. Cl.
*C25D 5/08* (2006.01)
*C25D 21/10* (2006.01)
(Continued)

(52) U.S. Cl.
CPC ..... *C25D 5/026* (2013.01); *C25D 5/08* (2013.01); *C25D 7/04* (2013.01); *C25D 17/004* (2013.01); *C25D 17/02* (2013.01); *C25D 17/12* (2013.01)

(58) Field of Classification Search
CPC ..... C25D 17/001; C25D 5/08; C25D 17/02; C25D 21/10; C25D 7/04; C25D 5/026; C25D 17/00
(Continued)

(56) References Cited

U.S. PATENT DOCUMENTS 2,181,490 A * 11/1939 Lowe ..... C25D 5/04 204/218
2007/0221495 A1* 9/2007 Manens ..... H01L 21/32125 204/212

FOREIGN PATENT DOCUMENTS

JP 61-133397 6/1986
JP 63-6637 2/1988

OTHER PUBLICATIONS

English Translation of JP61-133397 to Sako et al; 1984.*

* cited by examiner

*Primary Examiner* — Zulmariam Mendez
(74) *Attorney, Agent, or Firm* — Clark & Brody

(57) ABSTRACT

An electroplating apparatus applies an electroplated coating to a female thread formed on a pipe end portion of a steel pipe. The apparatus includes an inner seal member, a capsule, a discharge outlet, an opening, a cylindrical insoluble anode, a plating solution supply tube, and a plurality of nozzles. The seal member divides the interior of the steel pipe at a location longitudinally inward of a region on which the female thread is formed. The capsule is attached to the pipe end portion. The outlet is designed to discharge a plating solution inside the capsule therefrom. The opening
(Continued)

facilitates discharge of the solution inside the capsule. The anode is disposed in the inside of the pipe end portion. The supply tube projects from an end of the anode. The nozzles eject a plating solution between the outer surface of the anode and the inner surface of the pipe end portion.

2 Claims, 1 Drawing Sheet

(51) Int. Cl.

| | |
|---|---|
| ***C25D 7/04*** | (2006.01) |
| ***C25D 17/00*** | (2006.01) |
| ***C25D 5/02*** | (2006.01) |
| ***C25D 17/12*** | (2006.01) |
| ***C25D 17/02*** | (2006.01) |

(58) Field of Classification Search
USPC ..... 204/275.1
See application file for complete search history.

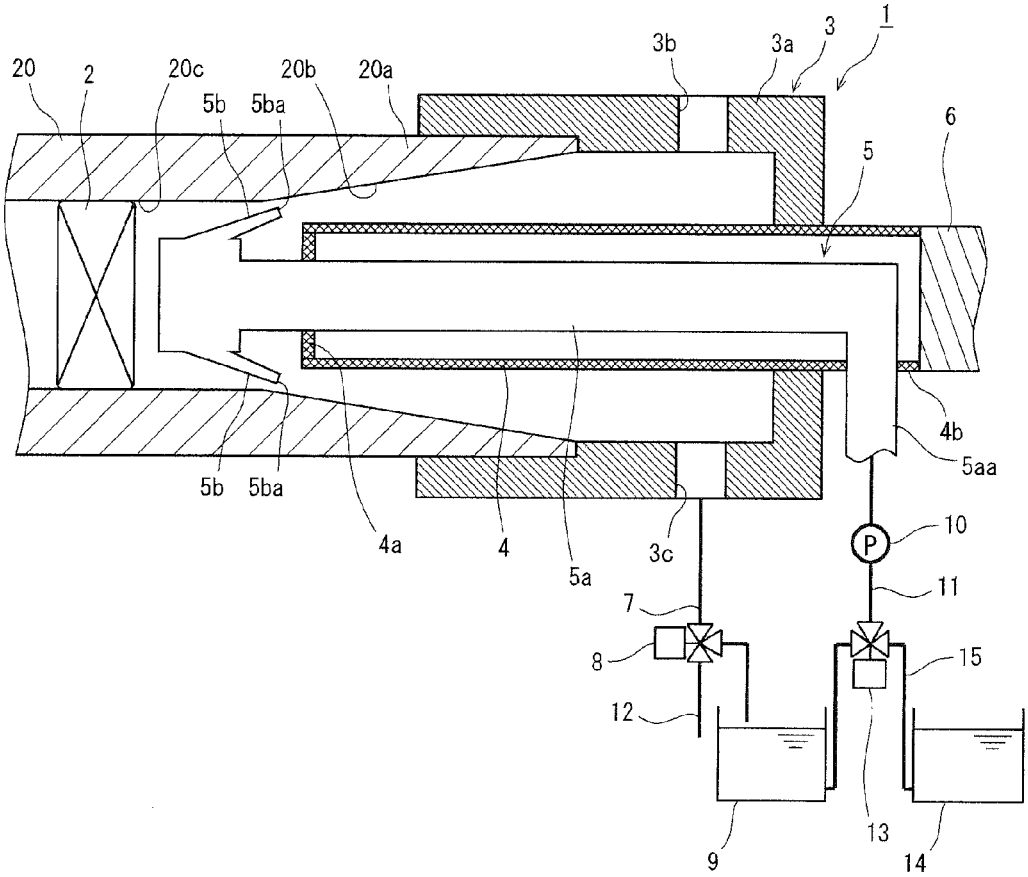
1
3
3a
3b
20
2
20c
20b
20a
5b
5ba
6
5
4b
5aa
5b
5ba
4a
4
5a
3c
10
P
11
7
8
15
12
9
13
14

ELECTROPLATING APPARATUS FOR STEEL PIPES

TECHNICAL FIELD

The present invention relates to an electroplating apparatus for steel pipes. More particularly, the present invention relates to an electroplating apparatus for steel pipes configured to apply an electroplated coating to a female thread formed on a pipe end portion of a steel pipe as a threaded joint element.

BACKGROUND ART

In oil wells, natural gas wells, and the like (hereinafter also collectively referred to as "oil wells"), oil country tubular goods are used for extraction of underground resources (e.g., petroleum, natural gas, etc.). Oil country tubular goods, which are steel pipes, are configured to be sequentially connected to each other, and threaded joints are used for the connection.

Such threaded joints are generally classified into two types, a coupling-type joint and an integral-type joint. A coupling-type threaded joint is constituted by a pair of tubular goods that are to be connected to each other, of which one is a steel pipe having a longer length and the other is a coupling having a shorter length. In this case, the steel pipe is provided with a male thread formed on the outer periphery at each end portion thereof, and the coupling is provided with a female thread formed on the inner periphery at each end portion thereof. The male thread of the steel pipe is screwed into the female thread of the coupling, thereby making up a joint between them. An integral-type threaded joint is constituted by a pair of steel pipes as tubular goods that are to be connected to each other, without a separate coupling being used. In this case, each steel pipe is provided with a male thread formed on the outer periphery at one of its opposite end portions and a female thread formed on the inner periphery at the other thereof. The male thread of one of the steel pipes is screwed into the female thread of the other of the steel pipes, thereby making up a joint between them.

In recent years, from the standpoint of improving the manufacturability of oil country tubular goods, there is an increasing need for using a threaded joint of the integral type. This is because no separate coupling is required.

When making up steel pipes, lubricating grease (dope) is applied to the male thread and the female thread. The purpose of this is to prevent galling in the threads and also to enhance the sealing performance of the threaded joint. Conventionally, as the lubricating grease, lubricants specified by API (American Petroleum Institute) standards (hereinafter also referred to as "API dope") are widely used. API dope contains heavy metals such as Pb (lead) and exhibits high lubricity.

In recent years, environmental regulations have become more stringent. Thus, the use of API dope has been restricted, and a need has arisen for use of lubricating grease free of heavy metals (hereinafter also referred to as "green dope"). However, green dope has lower lubricity than API dope. Because of this, in the case of using green dope, it is necessary to apply an electroplated coating such as a copper coating to the surface of at least one of the male thread and the female thread. The purpose of this is to prevent galling in the threads by compensating for the insufficient lubricity.

When applying an electroplated coating to a coupling-type threaded joint, the coating is applied to the female thread of the coupling. Threaded joints having an electroplated coating on the female thread of the coupling exhibit high reliability. Because of the high reliability, when applying an electroplated coating to an integral-type threaded joint, too, it is increasingly desired that the coating be applied to its female thread on the pipe end portion of the steel pipe.

Japanese Patent Publication No. S63-6637 (Patent Literature 1) discloses an apparatus for applying an electroplated coating to a male threaded region formed on one of the pipe end portions of a steel pipe, i.e., to the outer peripheral surface at a pipe end portion of a steel pipe.

CITATION LIST

Patent Literature

Patent Literature 1: Japanese Patent Publication No. S63-6637

SUMMARY OF INVENTION

Technical Problem

During an electroplating process, typically, bubbles of hydrogen, oxygen, or the like are generated while a plated layer is formed. When an electroplated coating is applied to a male thread formed on the outer periphery of a pipe end portion, as disclosed in Patent Literature 1, gas bubbles quickly depart from the surface of the male thread and float. Thus, gas bubbles do not cause a problem. However, when an electroplated coating is applied to a female thread formed on the inner periphery of a pipe end portion, gas bubbles are retained, in particular on an upper portion of the inner periphery of the pipe end portion. The regions where the gas bubbles are retained become unintentional bare spots.

Further, once the electroplating process is completed, the plating solution needs to be promptly removed from the pipe end portion. The reason for this is that corrosion caused by the plating solution develops and results in tarnishing of the surface of the plated layer. In this regard, with the electroplating apparatus disclosed in Patent Literature 1, discharging the spent plating solution from the cell is time-consuming because the cell which houses the pipe end portion and the plating solution is a completely closed system. As a result, assuming that a large diameter steel pipe is the object to be treated, if an electroplated coating is applied to a female thread on a pipe end thereof, tarnishing will occur in the plated layer formed on the female thread.

Typically, after the spent plating solution is discharged, water is introduced into the cell in place of the plating solution to rinse the pipe end portion with water. If the amount of waste water from the water rinsing is increased, the cost of waste water treatment is increased. Thus, reduction of the amount of waste water is desired.

An object of the present invention is to provide an electroplating apparatus for steel pipes having the following characteristics:

- Preventing the retention of gas bubbles formed during an electroplating process regardless of the size of the steel pipe;
- Promptly removing the spent plating solution after the electroplating process; and
- Reducing the amount of waste water.

Solution to Problem

An electroplating apparatus for a steel pipe according to an embodiment of the present invention is configured to apply an electroplated coating to a female thread formed on a pipe end portion of the steel pipe.

The electroplating apparatus includes: an inner seal member; a capsule; a discharge outlet; an opening; a cylindrical insoluble anode; and a plating solution supply mechanism.

The inner seal member is disposed in an interior of the steel pipe and divides the interior of the steel pipe at a location longitudinally inward of a region on which the female thread is formed.

The capsule is sealingly attached to the pipe end portion.

The discharge outlet is formed in the capsule to discharge a plating solution inside the capsule therefrom.

The opening is formed in the capsule to facilitate the discharge of the plating solution inside the capsule.

The insoluble anode is disposed in an inside of the pipe end portion while passing through the capsule in a sealed relationship to the capsule.

The plating solution supply mechanism supplies the plating solution to the inside of the pipe end portion sealed by the inner seal member and the capsule.

The plating solution supply mechanism includes a plating solution supply tube and a plurality of nozzles.

The plating solution supply tube extends along an axis of the insoluble anode and projects from a leading end of the insoluble anode in the inside of the pipe end portion. The nozzles are attached to a leading end portion of the plating solution supply tube to eject the plating solution between an outer peripheral surface of the insoluble anode and an inner peripheral surface of the pipe end portion.

The insoluble anode has a configuration that does not allow ingress of the plating solution ejected from the nozzles to the insoluble anode.

Preferably, in the above electroplating apparatus, the opening is located in an upper portion of the capsule and is opened to the atmosphere when discharging the plating solution after being spent.

Preferably, in the above electroplating apparatus, the configuration of the insoluble anode that does not allow ingress of the plating solution is such that a cover is provided at the leading end of the insoluble anode and the plating solution supply tube passes through the cover in a sealed relationship to the cover.

Advantageous Effects of Invention

An electroplating apparatus for steel pipes of the present invention has the following significant advantages:

- Ability to prevent the retention of gas bubbles formed during a plating process regardless of the size of the steel pipe;
- Ability to promptly remove the spent plating solution after the plating process; and
- Ability to reduce the amount of waste water.

BRIEF DESCRIPTION OF DRAWINGS

FIG. 1 is a schematic longitudinal sectional view showing a configuration of an electroplating apparatus for steel pipes according to an embodiment of the present invention.

DESCRIPTION OF EMBODIMENTS

In order to achieve the above object, the present inventors have conducted intensive studies and consequently made the following findings (A) to (D).

(A) If the ejection of a plating solution between a female thread and an anode is in the form of a helical jet from a plurality of nozzles, gas bubbles that are formed during a plating process will be blown quickly, and therefore bare spots due to retention of gas bubbles will be prevented.

(B) In order to enable prompt discharge of the spent plating solution remaining within the pipe end portion of the steel pipe after completion of the plating process, it may be advantageous to provide a structure for facilitating discharge of the spent plating solution. By means of this, tarnishing of the plated layer resulting from corrosion caused by the plating solution will be prevented.

(C) By specifying the locations of nozzles for ejecting the plating solution and the ejection directions, stable formation of a plated layer will be possible regardless of the size of the steel pipe. Specifically, when a small diameter pipe is the object to be treated, the occurrence of bare spots and surface tarnishing will be prevented. When a large diameter pipe is the object to be treated, the increase in the amount of waste water will be prevented. As used herein, the term "small diameter pipe" refers to a pipe having an outside diameter of 4 inches or less, the term "medium diameter pipe" refers to a pipe having an outside diameter in the range of greater than 4 inches to 9 inches or less, and the term "large diameter pipe" refers to a pipe having an outside diameter of greater than 9 inches.

(D) By specifying the form of the insoluble anode and the form of the plating solution supply mechanism, it will be possible to reduce the amount of waste water including the plating solution.

The electroplating apparatus of the present invention has been made based on the above findings. Hereinafter, embodiments of the electroplating apparatus of the present invention will be described with reference to the drawings.

FIG. 1 is a schematic longitudinal sectional view showing a configuration of an electroplating apparatus for steel pipes according to an embodiment of the present invention. As shown in FIG. 1, an electroplating apparatus 1 is an apparatus configured to apply an electroplated coating to a female thread 20*b* of a steel pipe 20.

The female thread 20*b* is formed on the inner periphery of one of the pipe end portions 20*a* of the steel pipe 20. FIG. 1 shows an embodiment in which the steel pipe 20 is positioned generally horizontally. Alternatively, the steel pipe 20 may be positioned in an inclined manner such that the end region at the electroplating apparatus 1 side is slightly lower than the opposite end region. Positioning the steel pipe 20 in an inclined manner as described above has advantages in respect of preventing leakage of the plating solution from the interior of the steel pipe 20 to the region opposite to the electroplating apparatus 1 and reducing the retention of the plating solution in the pipe end portion 20*a* when the plating solution is discharged. In the following description, by way of example, the steel pipe 20 is a seamless oil country tubular good having a long length configured to be connected with an integral-type threaded joint.

The electroplating apparatus 1 includes an inner seal member 2, a capsule 3, an insoluble anode 4, and a plating solution supply mechanism 5. In the following, these structural elements are described one by one.

[Inner Seal Member]

The inner seal member 2 is inserted into the interior of the steel pipe 20 and is placed at a predetermined location 20*c* longitudinally (horizontal direction in FIG. 1) inward of the region on which the female thread 20*b* is formed. The inner seal member 2 is in contact with the entire circumference of the inner peripheral surface of the steel pipe 20, and divides the interior of the steel pipe 20 at the predetermined location

20*c*. In this manner, the inside of the pipe end portion 20*a* is sealed internally by the inner seal member 2. The predetermined location 20*c* as referred to herein is not particularly limited as long as it is longitudinally inward of the region on which the female thread 20*b* of the steel pipe 20 is formed.

The inner seal member 2 may be of any configuration as long as it can divide the interior of the steel pipe 20 and internally seal the inside of the pipe end portion 20*a* thereof. An example of the inner seal member 2 is a HEXA plug (from Mutsubishi Rubber Co., Ltd.), which is for use in closing piping in piping work at industrial process plants for petroleum, gases, chemicals, etc. A HEXA plug includes a rubber ring having a C-shaped cross section and a pair of flat plates that firmly hold the rubber ring therebetween. The rubber ring is expanded in diameter by being tightly held between the pair of flat plates. This brings the rubber ring into contact with the entire circumference of the inner peripheral surface of the pipe to thereby seal the interior of the pipe integrally with the flat plates.

[Capsule]

The capsule 3 has a cylindrical capsule body 3*a* having a closed end face. The capsule body 3*a* is attached to the pipe end portion 20*a* of the steel pipe 20. Specifically, the capsule body 3*a* is in intimate contact with the outer peripheral surface of the pipe end portion 20*a* and is in intimate contact with the end face of the pipe end portion 20*a*. In this manner, the capsule 3 externally seals the inside of the pipe end portion 20*a* of the steel pipe 20 with the capsule body 3*a* being attached to the pipe end portion 20*a* of the steel pipe 20 in intimate contact. In short, the inside of the pipe end portion 20*a* is sealed by the inner seal member 2 and the capsule 3.

The capsule body 3*a* is provided with a discharge outlet 3*c* and an opening 3*b*. The discharge outlet 3*c* is primarily designed to discharge the spent plating solution after completion of the electroplating process. In addition, the discharge outlet 3*c* is designed to continuously discharge and collect the plating solution inside the capsule body 3*a* during the electroplating process and supply the collected plating solution to the area inside the capsule body 3*a* from the plating solution supply mechanism 5. Further, the discharge outlet 3*c* is designed to discharge waste water from water rinsing that is performed after the discharge of the plating solution. The discharge outlet 3*c* is located at a lower elevation than the inner peripheral surface of the pipe end portion 20*a* of the steel pipe 20.

A discharge tube 7 is connected to the discharge outlet 3*c*. The discharge tube 7 at an end thereof is open to a solution tank 9 for storing the plating solution. The discharge tube 7 is provided with a valve 8 for selecting between passages for discharging the plating solution (e.g., three-way valve). A waste water tube 12 is connected to the discharge valve 8. The waste water tube 12 at an end thereof is open to an external waste water tank (not shown).

When performing a plating process, the passage leading to the solution tank 9 is opened through the discharge valve 8. With this, the plating solution inside the capsule body 3*a* can be continuously collected and recirculated. Likewise, when discharging the spent plating solution after completion of the plating process, the passage leading to the solution tank 9 is opened. With this, the plating solution inside the capsule body 3*a* can be collected in the solution tank 9. When performing water rinsing after discharge of the plating solution, the passage leading to the waste water tube 12 is opened through the discharge valve 8. With this, waste water inside the capsule body 3*a* can be discharged to the waste water tank.

The opening 3*b* is provided to facilitate the discharge of the spent plating solution. The location of the opening 3*b* is not particularly limited as long as it can facilitate the discharge of the plating solution. For example, as shown in FIG. 1, the opening 3*b* is located in an upper portion of the capsule body 3*a*. The opening 3*b* is preferably located at a higher elevation than the inner peripheral surface of the pipe end portion 20*a* of the steel pipe 20.

The configuration may be such that a solenoid valve (not shown) is connected to the opening 3*b* so that the opening 3*b* can be opened and closed by the solenoid valve. When this configuration is employed, the solenoid valve is opened after completion of the plating process so that the opening 3*b* is opened to the atmosphere. This allows atmospheric pressure to act on the plating solution inside the capsule body 3*a*, thereby facilitating the discharge of the plating solution from the discharge outlet 3*c*.

Alternatively, the configuration may be such that a hose extending upwardly (not shown) is connected to the opening 3*b*. In this case, during the plating process, the pressure of the plating solution supplied to the area inside the capsule body 3*a* from the plating solution supply mechanism 5 by a pump 10 described below and the weight of the plating solution introduced into the hose are balanced so that the plating solution is prevented from squirting out of the capsule body 3*a*.

Furthermore, the configuration may be such that a compressor (not shown) is connected to the hose. When this configuration is employed, compressed air is delivered to the area inside the capsule body 3*a* from the opening 3*b* by the compressor after completion of the plating process. Thus, high pressure acts on the plating solution inside the capsule body 3*a*, thereby facilitating the discharge of the plating solution from the discharge outlet 3*c*.

As described above, the opening 3*b* provided in the capsule body 3*a* facilitates the discharge of the plating solution from the discharge outlet 3*c*. Consequently, the discharge of the spent plating solution is accomplished quickly, and therefore no tarnishing occurs on the surface of the plated layer formed on the female thread 20*b*.

[Insoluble Anode]

An insoluble anode 4 (hereinafter also referred to simply as "anode" 4) is a cylindrical electrode (anode) for applying an electroplated coating to the female thread 20*b*. The insoluble anode 4 passes through the end face of the capsule body 3*a* and extends to the inside of the pipe end portion 20*a* of the steel pipe 20. Thus, the anode 4 is positioned near the female thread 20*b*. The capsule body 3*a* and the anode 4 passing through the capsule body 3*a* are sealed by an O-ring or the like. The anode 4 is supported by the capsule body 3*a*.

As the anode 4, a cylindrical body formed from a titanium plate coated with iridium oxide, a stainless steel plate, or the like, is used.

An electrically conductive rod 6 is connected to the anode 4. Examples of the electrically conductive rod 6 include a titanium rod, a stainless steel rod, and the like.

A potential difference is applied between the anode 4 and the pipe end portion 20*a* of the steel pipe 20 surrounding the anode 4, across the plating solution. With this, an electroplated coating is applied to the female thread 20*b* of the steel pipe 20.

As described above, the anode 4 has a cylindrical shape and is hollow inside. Thus, the anode 4 is light weight and easy to handle. Also, the material cost therefor can be reduced. It is to be noted that the anode 4 has a configuration that does not allow ingress thereto of the plating solution ejected from the nozzles 5*b* described below. Because of this, the discharge of the plating solution after completion of the plating process is expedited. As a result, surface tarnishing of the plated layer formed on the female thread 20*b* is further prevented.

The configuration that does not allow ingress of the plating solution to the anode 4 is not particularly limited, but, for example, the following configuration may be employed. A cover 4*a* having a donut shape is provided at a leading end of the anode 4 disposed within the pipe end portion 20*a*. The cover 4*a* is joined to the anode 4 by welding or the like and separates the inside of the anode 4 from the outside thereof. It is noted that a plating solution supply tube 5*a* described below passes through the cover 4*a*. The cover 4*a* and the plating solution supply tube 5*a* passing through the cover 4*a* are sealed by an O-ring or the like.

[Plating Solution Supply Mechanism]

The plating solution supply mechanism 5 supplies a plating solution to the inside of the pipe end portion 20*a* sealed by the inner seal member 2 and the capsule 3. Specifically, the plating solution supply mechanism 5 includes a plating solution supply tube 5*a* and a plurality of nozzles 5*b*. The plating solution supply tube 5*a* extends along the axis of the anode 4, and projects from a leading end (the cover 4*a* in the electroplating apparatus 1 shown in FIG. 1) of the anode 4 in the inside of the pipe end portion 20*a*. The nozzles 5*b* are attached to a leading end portion of the plating solution supply tube 5*a* projecting from the leading end of the anode 4. A trailing end portion 5*aa* of the plating solution supply tube 5*a* passes through a side portion of a trailing end portion 4*b* of the anode 4 projecting outwardly from the capsule body 3*a*, and extends outwardly. The plating solution supply tube 5*a* is supported by the capsule body 3*a* via the anode 4.

A main tube 11 from the solution tank 9 for storing the plating solution is connected to the trailing end portion 5*aa* of the plating solution supply tube 5*a*. The main tube 11 is provided with a pump 10 for pumping the plating solution to the plating solution supply tube 5*a*. Further, the main tube 11 is provided with a valve 13, between the pump 10 and the solution tank 9, for selecting between passages for supplying the plating solution (e.g., three-way valve). A water tube 15 from a water tank 14 for storing water for water rinsing is connected to the supply valve 13.

When performing a plating process, the passage from the solution tank 9 to the plating solution supply tube 5*a* is opened through the supply valve 13. Further, the pump 10 is actuated. This allows the plating solution to be supplied to the area inside the capsule body 3*a* through the plating solution supply tube 5*a*. When discharging the spent plating solution after completion of the plating process, the operation of the pump 10 is stopped. Thus, the supply of the plating solution to the area inside the capsule body 3*a* is stopped, and the plating solution inside the capsule body 3*a* is collected in the solution tank 9. When performing water rinsing after discharge of the plating solution, the passage from the water tank 14 to the plating solution supply tube 5*a* is opened through the supply valve 13. Further, the pump 10 is actuated. This allows water to be introduced into the area inside the capsule body 3*a* through the plating solution supply tube 5*a*, so as to rinse the pipe end portion 20*a* of the steel pipe 20 with water.

The nozzles 5*b* are positioned inward of the leading end of the anode 4 in the longitudinal direction of the steel pipe 20, and each nozzle tip 5*ba* is pointed toward the outside of the pipe end portion 20*a* in the longitudinal direction. The plating solution pumped to the plating solution supply tube 5*a* is ejected from the nozzles 5*b* in the form of a helical jet between the outer peripheral surface of the anode 4 and the inner peripheral surface of the pipe end portion 20*a* (the female thread 20*b* formed on the pipe end portion 20*a*, to be exact). The number of the nozzles 5*b* is not particularly limited, but it is preferably two or more, and more preferably three or more.

With regard to the locations of the nozzles, one simple configuration is such that the nozzles are disposed on the end surface of the capsule body 3*a*, i.e., the nozzles are disposed outside the pipe end portion 20*a* in the longitudinal direction. However, this configuration is not employed for the electroplating apparatus of the present embodiment for the following reasons.

The size of the steel pipe 20 ranges broadly, for example, from about 60 mm to about 410 mm in outside diameter. When the steel pipe 20 is a small diameter pipe, a small outside diameter cylindrical anode 4 is used. In this case, if the nozzles are positioned outside the pipe end portion 20*a*, jets of the plating solution from the nozzles are greatly affected by return flows of the plating solution from the inside of the pipe end portion 20*a* toward the discharge outlet 3*c* located outside the pipe end portion 20*a*. Because of this, sufficient jet streams from the nozzles cannot be obtained. As a result, retention of gas bubbles may occur and bare spots may be caused.

On the other hand, when the steel pipe 20 is a large diameter pipe, even if the nozzles are positioned outside the pipe end portion 20*a*, it is possible to obtain sufficient jet streams of the plating solution as long as the power of the pump 10 is ensured, so that retention of gas bubbles does not occur and no bare spots are caused. However, in this case, if the nozzles are positioned outside the pipe end portion 20*a*, the discharge of the plating solution becomes time-consuming when discharging the spent plating solution after completion of the plating process, and this results in tarnishing of the surface of the plated layer formed on the female thread 20*b*. Furthermore, when performing water rinsing after discharge of the plating solution, the amount of waste water from the water rinsing is increased if the nozzles are positioned outside the pipe end portion 20*a*, and this results in increased costs of waste water treatment.

Specifically, when the steel pipe 20 is a small diameter pipe of 2⅞ inches (73.03 mm) in outside diameter, if the nozzle tips are positioned outside the pipe end portion 20*a*, it is impossible to obtain uniform and sufficient jet streams, and this results in retention of gas bubbles and the occurrence of bare spots. In contrast, when the tips 5*ba* of the nozzles 5*b* are positioned inward of the leading end of the anode 4 in the longitudinal direction of the steel pipe 20 as in the present embodiment described above, neither bare spots nor surface tarnishing occurs. This is because uniform and sufficient jet streams are formed between the female thread 20*b* and the anode 4, and therefore no retention of the plating solution occurs. The outside diameter of the steel pipe 20 (2⅞ inches (73.03 mm) as presented herein is a nominal outside diameter specified by API standards, and the same notation is used below.

Next, when the steel pipe 20 is a medium diameter pipe of 7⅝ inches (193.68 mm) in outside diameter, bare spots or tarnishing rarely occurs even if the nozzle tips are positioned outside the pipe end portion 20*a*. However, the amount of waste water is increased, resulting in increased costs of waste water treatment.

When the steel pipe 20 is a large diameter pipe of 13⅜ inches (339.73 mm) in outside diameter, it is possible to obtain sufficient jet streams even if the nozzle tips are positioned outside the pipe end portion 20*a*, and therefore bare spots due to retention of gas bubbles are not caused. However, discharge of the large volume of plating solution is time-consuming, and therefore surface tarnishing is likely to occur. In contrast, when the nozzles 5*b* are positioned inward of the leading end of the anode 4 in the longitudinal direction of the steel pipe 20 as in the present embodiment described above, the volume of the plating solution is actually reduced, and this results in rapid discharge of the plating solution. Thus, surface tarnishing does not occur. Moreover, the amount of waste water is reduced to about one-tenth, which results in a significant reduction in costs of waste water treatment.

For the above reasons, the electroplating apparatus 1 is configured such that the nozzles 5*b* and their tips 5*ba* are positioned inward of the leading end of the anode 4 in the longitudinal direction of the steel pipe 20, and each nozzle tip 5*ba* is pointed toward the outside of the pipe end portion 20*a* in the longitudinal direction.

The tips 5*ba* of the nozzles 5*b* are preferably positioned, in the radial direction of the steel pipe 20, between the female thread 20*b* and the anode 4.

The tips 5*ba* of the nozzles 5*b* shown in FIG. 1 have a straight shape pointed toward the female thread 20*b*. Alternatively, in order to enhance the uniformity of the jet streams that are formed between the female thread 20*b* and the anode 4, the tips 5*ba* of the nozzles 5*b* may be inclined toward the outside of the steel pipe 20 in the radial direction, for example, depending on the diameter of the steel pipe 20, the dimension of the female thread 20*b*, or the like. Furthermore, when performing electroplating on steel pipes 20 having different sizes, it is preferred that the direction in which the plating solution is ejected from the nozzles 5*b* is appropriately modified for each of the steel pipes 20 depending on its diameter, the dimension of its female thread 20*b*, or the like.

EXAMPLES

To verify the advantages of the electroplating apparatus of the present embodiment, the following test was conducted using the electroplating apparatus shown in FIG. 1. As plating solutions, a degreasing solution (sodium hydroxide: 50 g/L), a Ni strike bath (nickel chloride: 250 g/L, hydrochloric acid: 80 g/L), and a Cu electroplating bath (copper sulfate: 250 g/L, sulfuric acid: 110 g/L) were prepared. Then, using the baths in order, an electroplated coating (copper coating) was applied to a female thread on a pipe end portion of a steel pipe. Process conditions for each step using each bath were as shown in Table 1 below.

[Table 1]

TABLE 1

| Step | | | | | | | | |
|---|---|---|---|---|---|---|---|---|
| Cathodic Degreasing | | | Ni strike Process Conditions | | | Copper Coating | | |
| Bath Temp.(° C.) | Current Density (A/dm$^2$) | Treatment Time (Sec.) | Bath Temp.(° C.) | Current Density (A/dm$^2$) | Treatment Time (Sec.) | Bath Temp.(° C.) | Current Density (A/dm$^2$) | Treatment Time (Sec.) |
| 50 | 6 | 60 | 35 | 6 | 120 | 50 | 8 | 400 |

In the test, using steel pipes having different outside diameters, the nozzle location was varied between positions inward of the leading end of the anode and positions outside the pipe end portion. Also, the presence or absence of an opening in the capsule body was varied. Evaluations were conducted as to bare spots, tarnishing of the surface of the plated layer, and the amount of waste water from water rinsing that is performed between steps. Table 2 below shows the test conditions and the results obtained. The meanings of the reference symbols in the evaluation item sections (bare spots and tarnishing of surface of plated layer) of Table 2 are as follows.

[Bare Spots]

○ (Excellent): No bare spots were observed.

X (Poor): Many bare spots were observed.

[Tarnishing of Surface of Plated Layer]

○ (Excellent): No tarnishing was observed.

Δ (Fair): Minor tarnishing was observed.

X (Poor): Tarnishing was observed.

TABLE 2

| Classification | Pipe Size (OD/inch) | Nozzle Location | Opening | Bare Spots | Tarnishing | Waste Water Amount (L) |
|---|---|---|---|---|---|---|
| Comparative Example 1 | 2-⅞ (small diameter pipe) | Outside | Absent | x | x | 8.4 |
| Comparative Example 2 | 2-⅞ (small diameter pipe) | Outside | Present | x | Δ | 8.4 |

TABLE 2-continued

| Classification | Pipe Size (OD/inch) | Nozzle Location | Opening | Bare Spots | Tarnishing | Waste Water Amount (L) |
|---|---|---|---|---|---|---|
| Comparative Example 3 | 7-5/8 (medium diameter pipe) | Outside | Present | ○ | Δ | 102.4 |
| Comparative Example 4 | 13-3/8 (large diameter pipe) | Outside | Present | ○ | Δ | 343.2 |
| Example 1 | 2-7/8 (small diameter pipe) | Inside | Present | ○ | ○ | 6.2 |
| Example 2 | 7-5/8 (medium diameter pipe) | Inside | Present | ○ | ○ | 32.4 |
| Example 3 | 13-3/8 (large diameter pipe) | Inside | Present | ○ | ○ | 43.2 |

The results in Table 2 demonstrate the following. As seen in Comparative Examples 1 and 2, when a small diameter pipe was the object to be treated and the nozzles were positioned outside the pipe end portion, uniform and sufficient jet streams were not obtained, and therefore bare spots were caused because of retention of gas bubbles. In addition, as seen in Comparative Example 2, even when the capsule body had an opening, some tarnishing occurred on the surface of the plated layer.

In contrast, as seen in Example 1, when a small diameter pipe was the object to be treated and the nozzles were positioned inward of the leading end of the anode, neither bare spots nor surface tarnishing was observed. This is due to the fact that uniform and sufficient jet streams were formed between the female thread and the anode, and therefore retention of the plating solution did not occur.

As seen in Comparative Example 3, when a medium diameter pipe was the object to be treated and the nozzles were positioned outside the pipe end portion, no bare spots were caused. However, some surface tarnishing occurred and the amount of waste water was significantly increased.

In contrast, as seen in Example 2, when a medium diameter pipe was the object to be treated and the nozzles were positioned inward of the leading end of the anode, the amount of waste water was reduced to about one-third that of Comparative Example 3.

Also, as seen in Comparative Example 4, when a large diameter pipe was the object to be treated and the nozzles were positioned outside the pipe end portion, bare spots due to retention of gas bubbles did not occur because sufficient jet streams were obtained. However, discharge of the large volume of plating solution required a long time, and therefore some surface tarnishing occurred.

In contrast, as seen in Example 3, when a large diameter pipe was the object to be treated and the nozzles were positioned inward of the leading end of the anode, the volume of the plating solution was actually reduced, and as a result, rapid discharge of the plating solution was achieved, so that surface tarnishing did not occur. Moreover, the amount of waste water was reduced to about one-tenth that of Comparative Example 4.

INDUSTRIAL APPLICABILITY

The electroplating apparatus according to the present invention is useful in applying an electroplated coating to a variety of steel pipes having a female thread, including seamless oil country tubular goods configured to be connected using an integral-type threaded joint.

| REFERENCE SIGNS LIST | |
|---|---|
| 1: | electroplating apparatus, |
| 2: | inner seal member, |
| 3: | capsule, |
| 3a: | capsule body, |
| 3b: | opening, |
| 3c: | discharge outlet, |
| 4: | insoluble anode, |
| 4a: | cover of insoluble anode, |
| 4b: | trailing end portion of insoluble anode, |
| 5: | plating solution supply mechanism, |
| 5a: | plating solution supply tube, |
| 5aa: | trailing end portion of plating solution supply tube, |
| 5b: | nozzle, |
| 5ba: | nozzle tip, |
| 6: | electrically conductive rod, |
| 7: | discharge tube, |
| 8: | discharge valve, |
| 9: | solution tank, |
| 10: | pump, |
| 11: | main tube, |
| 12: | waste water tube, |
| 13: | supply valve, |
| 14: | water tank, |
| 15: | water tube, |
| 20: | steel pipe, |
| 20a: | pipe end portion, |
| 20b: | female thread, |
| 20c: | predetermined position |

The invention claimed is:

1. An electroplating apparatus for a steel pipe, the electroplating apparatus is configured to apply an electroplated coating to a female thread formed on a pipe end portion of the steel pipe, the electroplating apparatus comprising:

an inner seal member that is disposed in an interior of the steel pipe, the inner seal member dividing the interior of the steel pipe at a location longitudinally inward of a region on which the female thread is formed;

a capsule that is sealingly attached to the pipe end portion, the capsule having a discharge outlet through which a plating solution inside the capsule is discharged, the capsule having an opening that facilitates discharge of the plating solution inside the capsule;

an insoluble anode having a cylindrical shape, the insoluble anode being disposed in an inside of the pipe end portion, the insoluble anode passing through the capsule in a sealed relationship to the capsule; and a plating solution supply mechanism that supplies the plating solution to the inside of the pipe end portion sealed by the inner seal member and the capsule, wherein the plating solution supply mechanism includes:

a plating solution supply tube that extends along an axis of the insoluble anode, the plating solution supply tube projecting from a leading end of the insoluble anode in the inside of the pipe end portion; and a plurality of nozzles that are attached to a leading end portion of the plating solution supply tube, the nozzles being configured to eject the plating solution between an outer peripheral surface of the insoluble anode and an inner peripheral surface of the pipe end portion, and wherein a cover is provided at the leading end of the insoluble anode and the plating solution supply tube passes through the cover in a sealed relationship to the cover.

2. The electroplating apparatus according to claim 1, wherein:

the opening is located in an upper portion of the capsule and is opened to the atmosphere when discharging the plating solution after being spent.

* * * * *